United States Patent [19]

Ludwig

[11] 4,380,270

[45] Apr. 19, 1983

[54] TOOL DEVICE

[75] Inventor: David Ludwig, St. Louis, Mo.

[73] Assignee: Allan Air Products, Inc., St. Louis, Mo.

[21] Appl. No.: 227,754

[22] Filed: Jan. 23, 1981

[51] Int. Cl.[3] ..... F03B 13/00

[52] U.S. Cl. ..... 173/163; 51/170 T; 418/266

[58] Field of Search ..... 173/163, 170; 51/170 T; 418/108, 238, 266, 268

[56] References Cited

U.S. PATENT DOCUMENTS

| | | | |
|---|---|---|---|
| 3,097,571 | 7/1963 | Kaman | 173/163 X |
| 3,129,642 | 4/1964 | Sorensen | 173/163 X |
| 3,719,440 | 3/1973 | Snider | 418/266 |

*Primary Examiner*—Jimmy C. Peters

*Attorney, Agent, or Firm*—Spensley, Horn, Jubas & Lubitz

[57] ABSTRACT

This invention relates to a tool device. In the first embodiment, the device comprises a body defining a grip-like, handle, a tool holder joined to the body, a piston and valve assembly disposed in the body adjacent one end thereof, a conduit extending from the valve, a piston slideably disposed on the conduit, as well as means for supplying the device with a fluid under pressure. By the use of the first embodiment of the present invention, the piston is caused to reciprocate in the body thereby producing a hammer-like action. In the second embodiment of the invention, a similar tool handle is used in combination with a tool holder and motor assembly. The assembly includes means for selectively joining a tool to the assembly, and a rotary motor means having a plurality of radially disposed movable vane members, as well as means for introducing and removing a fluid from the motor. By the use of the second embodiment of the present invention, rotary action such as that associated with a rotary sander can be achieved.

1 Claim, 12 Drawing Figures

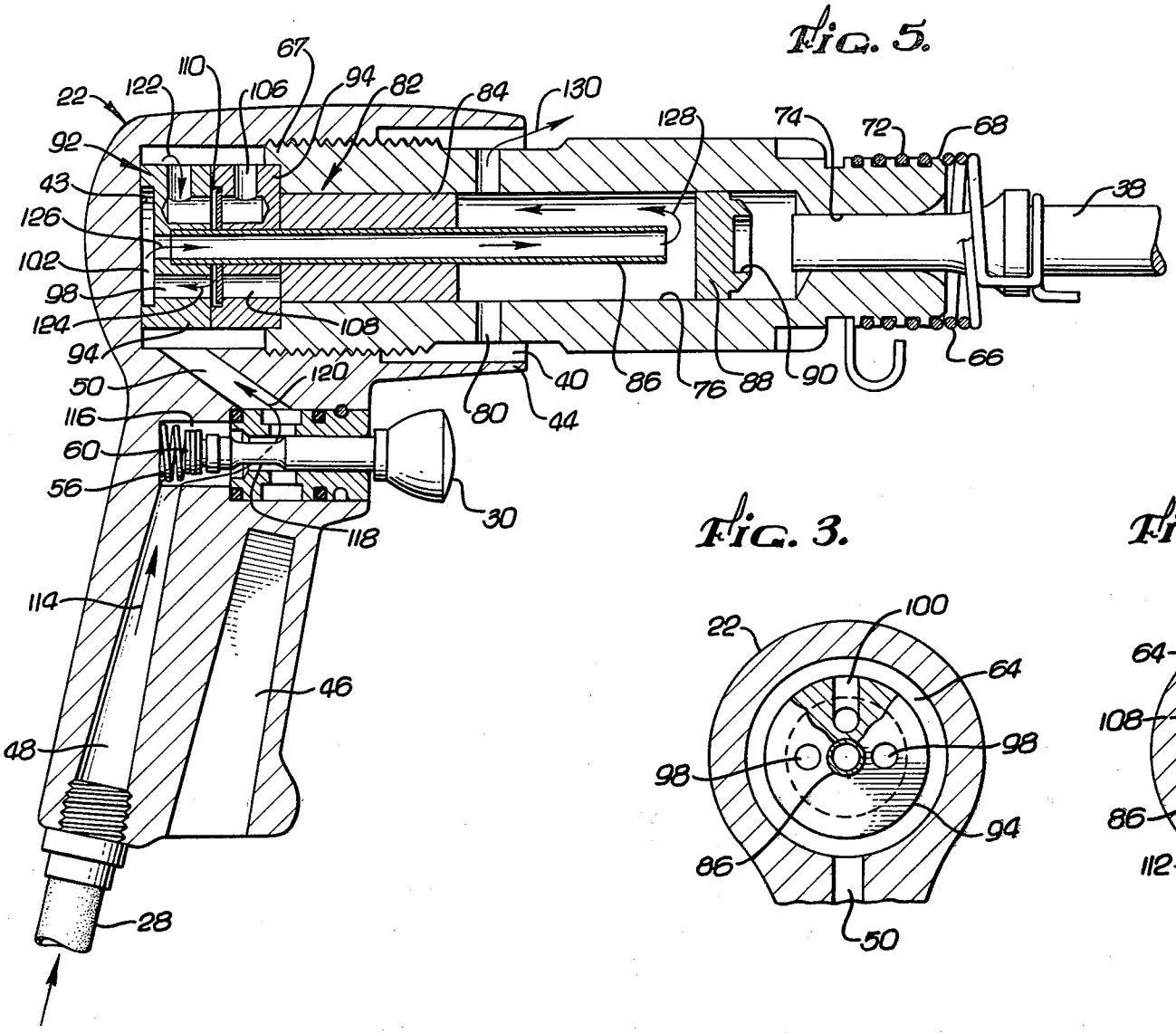
Fig. 5.
Fig. 3.
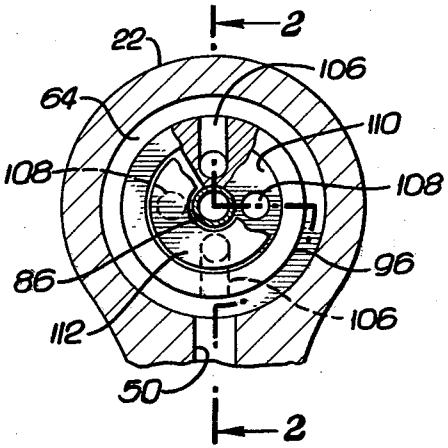
Fig. 4.

TOOL DEVICE

BACKGROUND OF THE INVENTION

1. Field of the Invention

The present invention relates to the field of tool devices, and more specifically, to rotary sanders, hammers, chisels and the like.

2. Prior Art

The use of air impact hammers and similar devices is well recognized in the prior art. The benefit of such devices is that they can be driven by a source of compressed air thereby obviating the need for direct electric current, gas powered motor or other similar power sources. Inasmuch as many modern factories are equipped today with compressed air or other pneumatic fluid, air-driven devices have gained wide acceptance.

Examples of prior art devices which utilize air as a driving means for an impaction tool are shown in U.S. Pat. Nos. 2,722,918 and 3,344,868. In each of these references, there is disclosed a device which utilizes air pressure as a means for driving a piston so as to impact upon another member thereby enabling the device to act as a hammer or similar surface working tool. Problems with such devices are that they are relatively complex, and/or are difficult to manufacture. In addition, they appear to be directed to a specific utility. Thus, substantial reconfiguration is required in order to readily convert a device used for a hammer to, say, a chisel-type device, even though the action of a chisel and hammer are related.

A similar device to the air impact hammer tool is the rotary pneumatic powered sander which has likewise gained wide acceptance. Exemplars of similar prior art devices are disclosed in U.S. Pat. Nos. 2,570,009; 2,545,453; 2,946,315; 3,642,389 and 3,728,052. These references are directed to a wide range of different rotary pneumatic tools which utilize a rotary motor having a plurality of outwardly extending blades or vanes. Notwithstanding the development and a clear recognition of the advantages of such devices in the prior art, a number of shortcomings remain. As with the air impact hammer, the prior art rotary pneumatic sanders are relatively complex and/or difficult to manufacture. In addition, many of them use a complex venting system.

Thus, it appears that there has been a long felt need for pneumatic devices which are relatively straight-forward in their design, and thus can be easily manufactured. It is likewise clear from the prior art that a device which could utilize at least some of the same parts, whether the device was being used as an air impact hammer or as a rotary sander, would be very beneficial. These and other long felt problems are solved by the device of the present invention.

BRIEF SUMMARY OF THE INVENTION

The present invention is directed to tool devices, and more specifically to a tool device which can be used in one embodiment as an air impact hammer or in another embodiment as a rotary sander. In the first embodiment, the device comprises a body having an integral handle attached thereto. The body is of such a configuration that with minor modification it can be used in either of the two embodiments disclosed herein. A uniquely configured tool holder is joined to the body and defines a bore. A piston and valve assembly which comprises a valve, a conduit extending from the valve, and a piston slideably disposed on the conduit are disposed in the bore. Means for supplying the valve with a fluid is provided. In the operation of the first embodiment of the present invention, the valve selectively directs fluid, such as pneumatic fluid under pressure, through the conduit to a first location adjacent a first end of the piston thereby moving the piston in a first direction. The valve then directs the fluid to a second location adjacent to a second end of the piston thereby moving the piston in a second direction. This reciprocal action takes place in such a manner that the piston impacts upon a selected tool thereby causing a hammer-like action to be produced.

In the second embodiment of the device of the present invention, the similar shaped body is utilized. In the second embodiment, however, a different tool holder and motor assembly is disposed in the body so as to extend outwardly therefrom. The assembly includes (i) means for securely joining a tool to the assembly, (ii) an elongated rotary motor having a plurality of radially disposed movable vane members, and (iii) first and second end plates disposed on the motor at each end thereof wherein one of the end plates has inlet means for directing fluid into the motor and the other has outlet means for directing the fluid out of the motor. In the manner, the motor is caused to rotate in the body thereby rotating the tool joining means. Means for directing fluid to the motor through one end and then out therefrom are also provided. The joining means which is circumferentially disposed about the assembly and has a plurality of openings in flow communication with the outlet openings on the end plate such that the fluid, after passing through the motor is directed out of the device in an efficient manner.

The novel features which are believed to be characteristic of the invention both as to its organization and method of operation, together with further objectives and advantages thereof will be better understood from the following description considered in connection with the accompanying drawings in which the presently preferred embodiment of the invention is illustrated by way of example. It is to be expressly understood, however, that the drawings are for the purpose of illustration and description only, and are not intended as a definition of the limits of the invention.

BRIEF DESCRIPTION OF THE DRAWINGS

FIG. 3 is a cut-away view of FIG. 2 taken along lines 3—3 and showing the piston and valve assembly;

FIG. 4 is a cut-away view of FIG. 2 taken along lines 4—4 and also showing the piston and valve assembly;

FIG. 5 is another cut-away front view of the first embodiment of the device showing the piston and valve assembly in a second position;

DETAILED DESCRIPTION OF THE INVENTION

Figures 1, 2:
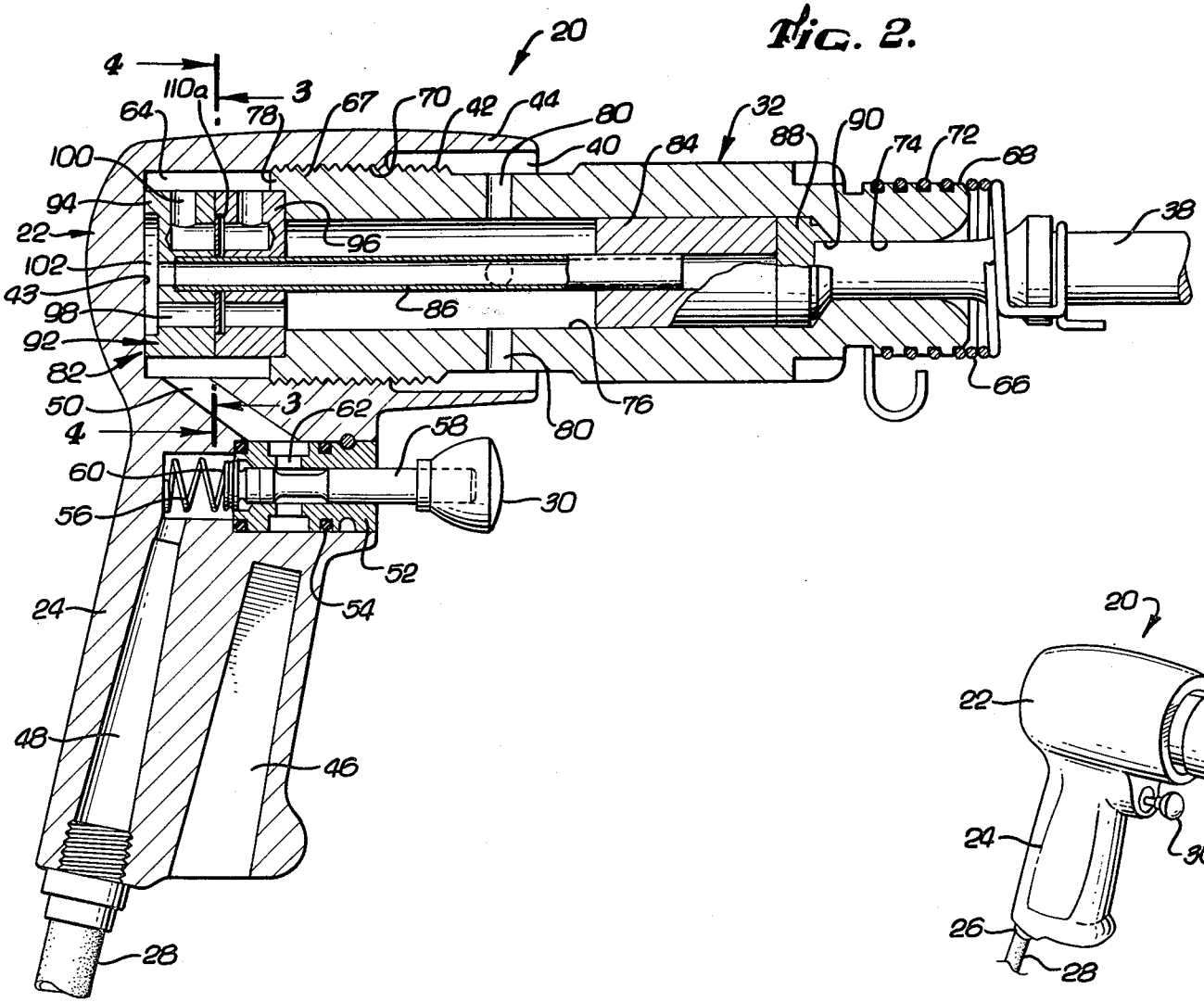
FIG. 1 is a perspective view of the first embodiment of the tool device of the present invention.
FIG. 2 is a cut-away front view of the tool device of the present invention showing the tool holder and piston and valve assembly.
Figure 6:
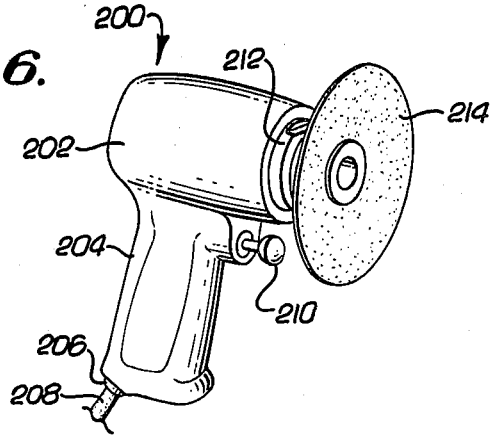
FIG. 6 is a perspective view of the second embodiment of the tool device of the present invention.

Referring first to FIG. 1, there is shown the first embodiment of the device of the present invention. The first embodiment is directed to a pneumatic tool device 20 having a metal body 22 with an integral handle 24. Because the first embodiment has special utility as a chisel it is sometimes referred to herein as chisel device 20. It should be understood that the pounding action of the piston described below could be used in many other embodiments. A coupling 26 is disposed on one end of handle 24 such that air hose 28 can be readily attached thereto. Air hose 28 as well as coupling 26 are well known in the prior art and will not be discussed in detail herein. Such coupling 26 and air hose 28 are used to direct air or other pneumatic fluid under pressure from a source (not shown) to the tool device 20.

The handle 24 is configured so that it may be easily grasped and manipulated by the user. A button actuator 30 is disposed on the handle and, when depressed, permits fluid to activate the device 20 as hereinafter described in greater detail. Extending outwardly from an opening in the device 20 is a tool holder assembly 32 having a cylindrical body element 34 and a tool retaining spring member 36. Spring member 36 is used to join a tool shaft 38 to the holder assembly 32. It should be recognized that while such method of joining does provide a number of unique benefits, other means of joining a tool to the assembly 32 are also within the scope of the present invention.

Referring now to FIG. 2, one can see that the body 22 has an opening or bore 40 defined by the body into which the assembly 32 extends. Integral teeth 42 on holder assembly 32 intermesh with teeth 70 internally formed within the bore 40 of the body 22. Body 22 has an internal terminis 43 at one end thereof and has a generally cylindrical rim 44 adjacent the other end thereof. As one can see, by having an open bore 40 and cylindrical rim 44, holder assembly 32 can be easily joined to and removed from body 22. This is one distinct advantage of the present invention in that it enables the device 20 to be easily assembled. In the prior art, many devices include end caps or complex means for joining the tool assembly to the body so as to substantially seal the open end thereof.

Handle 24 has an internally formed, generally rectangular opening 46 which enables the chisel device 20 to be mounted if so desired. A first conduit or channel 48 is also disposed through handle 24 and permits pneumatic fluid from hose 28 to pass into the chisel tool 20 as hereinafter described in greater detail. A second channel or conduit 50 extends from the handle 24 into the bore 40. To regulate the amount of fluid, button actuator 30 is used. Its construction is similar to that of a throttle valve. A bushing 52 and seal rings 54 retain the button actuator 30 in handle 24. A spring 56 urges button member 30 in a generally outward or closed position such that rod 48 prevents fluid from flowing through channel 48 into channel 50. Rod 58 has a flared end 60 which is attached to spring 56. When button member 30 is depressed, flow communication is then permitted from channel 48, through a channel 62, formed in bushing 52, into channel 50. This can be seen with reference to FIG. 5.

Referring again to FIG. 2, one can see that the tool holder assembly 32 has a first end 67 adjacent terminus 44 and a second end 68 which extends outwardly from the body 40. Tool holder assembly 32 extends into body 40 so as to define an annular space 64 adjacent terminus 43. Adjacent second end 68 are a plurality of notches 72 which engage spring 66. Other means for holding spring 66 to the assembly 32 are also within the scope of the present invention. However, certain advantages are achieved by the use of a spring and notch method. First, the desirable action similar to that of a chisel is achieved. Second, various tools can be quickly mounted or removed. Third, mounting of spring 66 on assembly 32 is relatively straightforward.

Referring to FIGS. 2 and 5, one can see that cylindrical tool holder assembly 32 defines a first bore 74 which is in axial communication with a second, larger bore 76. The first end 67 of assembly 32 forms a generally cylindrical rim 78. Rim 78 engages valve 92 and retains valve 92 in a generally fixed position against terminus 43. Orthoginal ports or openings 80 extend radially from the assembly 32, and permit the pneumatic fluid to exit therefrom.

Extending axially into the assembly 32, and disposed adjacent the terminis 43 of body 22, is the piston and valve assembly 82. Assembly 82 consists of a generally cylindrical piston 84, a hollow rod or guide member 86 and a valve 92. Guide member 86 permits piston 84 to travel along a straight path in a smooth manner even after much use. It thus represents yet another advantage of the present invention. Also disposed within the assembly 32 is a circular impaction element 88 which is impacted by movable piston 84. As more clearly shown in FIG. 5, impaction element or anvil 88 defines a recessed area 90 which is configured so as to matingly engage tool shaft 38. Anvil 88 enables the force of piston 84 to be readily transferred to tool shaft 38. Direct impact of a piston on a tool can lead to wear of the tool. The use of anvil 88 is yet another advantage of the present invention over the prior art.

Cylindrical valve 92, in the preferred embodiment, is comprised of a first section 94 and a second section 96 both of which can be made of metal. In the preferred embodiment, section 94 is made of a hard plastic such as PVC, polypropylene or polycarbonate. The use of a plastic permits valve 92 to absorb some of the shock when impacted by piston 84. As is more clearly shown in FIG. 3, the first section 94 has a plurality of openings 98 axially disposed therethrough. Openings 98 extend from area 110 formed in section 96 and located between the sections 94 and 96, to recessed area 102 formed in section 94 adjacent terminis 43. An opening 100, also formed in valve section 94, has a portion which extends radially outward from the axis of section 94, and another portion which makes a right angle bend as can be seen from FIGS. 2 and 3. In this manner, flow communication between recessed area 110, formed in section 96, and the annular space 64 is achieved.

Referring now to FIGS. 2 and 4, one can see that valve section 96 also has an opening 106 which extends outward so as to communicate with recessed area 110 and space 64. Openings 108 extend through section 96 so as to permit flow communication between recessed area 110 and bore 76. Disposed between sections 94 and 96, and occupying some of the space formed by recessed area 110 is a movable seal member 112. As discussed in greater detail hereinbelow, seal 112 shifts in position slightly as indicated in FIGS. 2 and 5 which enables pneumatic fluid to be alternatingly directed to each end of piston 84.

The operation of the pneumatic chisel device 20 will now be discussed.

Referring to FIG. 2, one can see that the seal member 112 is initially disposed across openings 98 and 100 in the first section 94 of valve 92. As indicated in FIG. 5, air or other pneumatic fluid flows through hose 28 into conduit 48 formed in handle 24. Flow through channel 48 is generally indicated by arrow 114. As the pneumatic fluid continues to flow in that direction, it flows into a chamber 116 formed in handle 24. One can see in FIG. 2 that the button actuator 30 has not been depressed and thus the fluid is not permitted to pass beyond chamber 116.

Referring now to FIG. 5, one can see that button actuator 30 has been depressed thereby permitting the fluid to flow around rod 58 and, more specifically, a tapered portion 118 thereof. The fluid would continue to flow through the handle 24 as indicated by arrow 120 and into the annular space 64 adjacent the terminus 43 of the body 22. Fluid would then flow through either opening 100 or 106 or both depending on the resistance. Should air initially flow through openings 100 as indicated by arrow 122, it would cause the seal 112 to shift against section 96 of valve 92 thereby sealing openings 106 and 108. Fluid would then flow through opening 100, into area 110 and back towards the terminis 43 as indicated by arrow 124. From here, it would flow through recessed area 102, formed in valve section 94, and into conduit 86 as indicated by arrow 126. The pneumatic fluid would then flow through conduit 86 and exit therefrom as indicated by arrow 128. Continued flow in this direction forces the piston 84 to axially move along guide member 86 and against second section 96 of valve 92. Movement of the piston 84 past ports 80 permits venting of the pneumatic fluid outwardly from the tool device 20 as indicated by arrows 130. Any fluid between piston 84 and valve 92 would be urged toward seal 112 through opening 108. If the pressure was great enough, seal 112 would axially move from space 110*a* into space 110 as shown in FIG. 2. This would uncover opening 106 through which the fluid would flow into space 64. As soon as the seal 112 shifted into the position shown in FIG. 2 pressure would build up in space 64. When the pressure was great enough, fluid would flow back through opening 106, into space 110*a* and out opening 108. Flow through openings 100 would be discouraged as it is closed off by seal 112. As pressure built up behind piston 94, ultimately the piston 94 would be driven forward guide member 86 with a high degree of velocity so as to strike anvil 88. This forward trajectory along guide member 86 and the impact on anvil 88 would cause an outward projection of tool 38. This chisel-like action can thus be used to, for example, aid in removal of a U-joint in an auto, loosen a brick or other material from a surface, and the like. Once piston 84 traveling along rod 86 passed beyond ports 80, additional fluid would flow through ports 50 thereby decreasing the pressure behind piston 84. This decrease in pressure would, in turn, permit additional pressure to build up behind seal 112, i.e., additional fluid would flow through opening 100 so as to again shift the seal 112 back into area 110*a*. Additional fluid flowing through opening 100 would flow into space 110, and out toward the terminus 43 through openings 98. As stated above, additional fluid flow through openings 98 would, in turn, flow into space 102 and then through conduit 86. As fluid exited from conduit 86, it would urge the piston 84 in the opposite direction. In this manner, a reciprocal action is achieved by piston 84. This reciprocal action is transferred to a pounding action or chisel-like action by the constant hammering of piston 84 on anvil 88 and, in turn, tool shaft 38.

Referring now to FIGS. 6–12, the second embodiment of the present invention will now be discussed.

In the second embodiment, a pneumatic rotary sander 200 is illustrated. It should be understood that other rotary-type devices are also within the scope of the present invention. Sander 200 is comprised of a metal body 202 having an integral handle 204. An air coupling 206 informed on body 22 and an associated air hose 208 is joined thereto. Air hose 208 would be connected to a source of pneumatic fluid (not shown) so as to drive the sander 200 as hereinbelow described in greater detail. A button actuator 210 similar in nature to that described with reference to actuator 30 is also disposed on handle 204. Extending outwardly from body 202 is a total holder and motor assembly 212. Tool holder and motor assembly 212 has a sanding disc 214 attached thereto.

Figure 7:
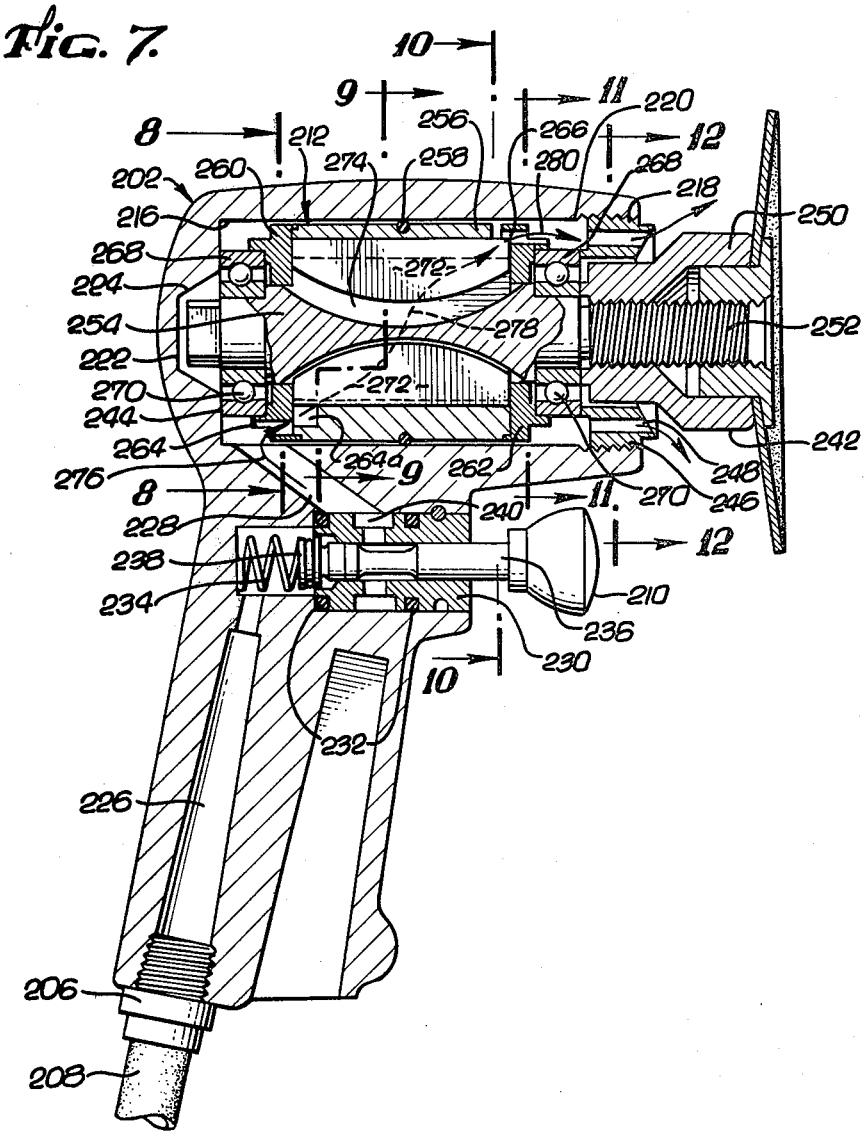
FIG. 7 is a cut-away front view of the second embodiment of the tool device of the present invention.
Figure 8:
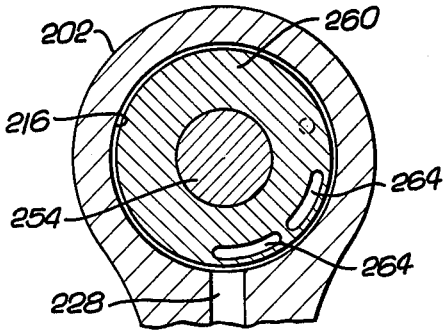
FIG. 8 is a cut-away view of FIG. 7 taken along lines 8—8 and showing a first end plate and inlet openings.
Figure 10:
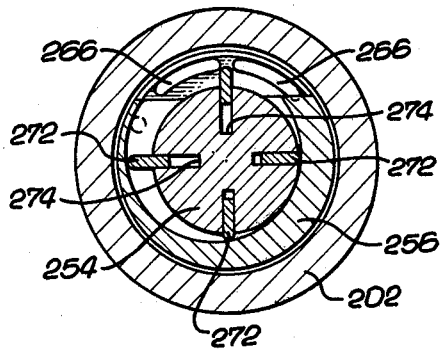
FIG. 10 is a cut-away view of FIG. 7 taken along lines 10—10 also showing the rotary motor and vanes.
Figure 9:
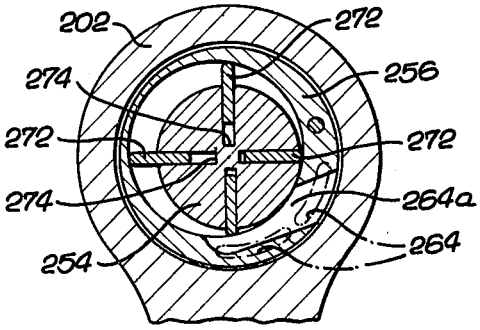
FIG. 9 is a cut-away view of FIG. 7 taken along lines 9—9 and showing the rotary motor and associated vanes.
Figure 11:
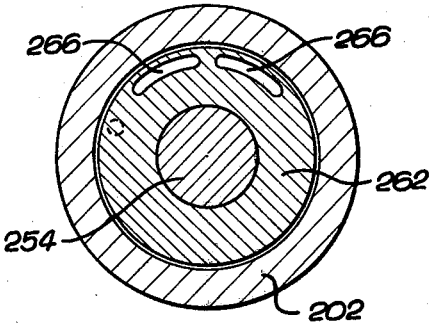
FIG. 11 is a cut-away view of FIG. 7 taken along lines 11—11 and showing a second end plate and outlet openings.
Figure 12:
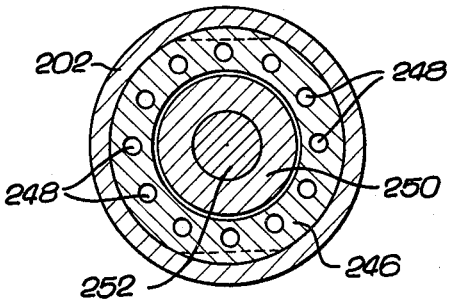
FIG. 12 is a cut-away view of FIG. 7 taken along lines 12—12 and showing the cylindrical joining member for joining the tool holder and motor assembly to the body.

As shown in FIG. 7, tool holder and motor assembly 212 extend into a bore 216 defined by body 202. Internal teeth 218 formed on body 202 are disposed adjacent a first end 220 of the bore 216, and a trapezoid section 224 is formed in body 200 adjacent the terminus 222 thereof.

Disposed in handle 204 is a first channel or conduit 226 which permits pneumatic fluid to flow to the tool holder and motor assembly 212 as hereinbelow described in greater detail. A second channel or conduit 228 directs the fluid into the bore 216. This flow is regulated by means of actuator 210 which is held in position by a bushing 230 and associated seal ring members 232. A spring 234 urges a shaft or rod 236 of the actuator 210 so as to remain in the closed position until depressed. One can see that rod element 236 has a flared end 238 which is engaged by spring element 234. When actuator 210 is depressed, fluid is permitted to flow through channel 226, passed the actuator 210 by flowing through channel 240 in flow communication both with channel 226 and channel 228.

In the preferred embodiment, tool holder and motor assembly 212 has a first end 242 and a second end 244. A threaded ring member 246 is disposed adjacent end 242 and is used to join the assembly 212 to the body 202. More specifically, teeth 218 on body 202 engages similar elements on member 246. Ring member 246 has a plurality of openings 248 which permit pneumatic fluid to exhaust outwardly therethrough as hereinafter described in greater detail. A disc or tool holder 250 is joined to a shaft 252 which is securely joined to the assembly 212. In the preferred embodiment, a disc 214 made of a flexible material upon which sanding paper or the like can be mounted is joined to holder 250. The tool holder 250 is threadingly engaged on shaft 252 which is joined to a rotor 254 which also forms part of the assembly 212. Rotor 254 is rotatably and axially disposed within and circumferentially surrounded by a housing or cage 256. In order to help secure housing 256 to body 202, an O-ring seal 258 is circumferentially disposed about housing 256. Seal 258 prevents some movement of housing 256 in bore 216, but is aided by means of the ring member 246.

Housing 256 also has a first end plate 260 and a second end plate 262. Inlet openings 264 are disposed through end plate 260, while outlet openings 266 are disposed through end plate 262. Disposed adjacent each end of the housing 256 are bushings 268 are bushings 268 which have associated ball bearing members 270 therein. In this manner, rotor 254 is secured in body 202 and is axially rotatable within the motor housing 256. As shown by reference to FIGS. 7, 9 and 10, spring loaded blade or vane members 272 extend radially outward from the rotor 254. Vanes 272 have a generally flat upper surface and a curved lower surface. They are disposed in associated arcuous slots 274 and engage the upper surfaces of an inner wall of housing 256 along the length thereof.

The operation of the device 200 of the second embodiment will now be discussed.

After the pneumatic rotary sander 200 is connected to a suitable pneumatic fluid source by means of air hose 208, upon pressing actuator 210 fluid is directed through channels 226, 240 and 228. From here, the fluid flows through inlet openings 264, ultimately proceeding through slot 264*a*. This flow path is generally shown by reference to arrow 276. Upon entry into housing 256, the pneumatic fluid would impinge upon one of the vane members 272. This causes the vane and hence the rotor 254 to rotate in housing 256. Because there is no axial alignment between cylindrical housing 256 and cylindrical rotor 254, the vanes 272 move in and out of associated slots 274. This is perhaps best shown in FIGS. 9 and 10. There one can see that while rotor 254 is in axial alignment with body 202, the bore in housing 256 is off-center. As the vanes 272 rotate, fluid initially trapped between two vanes is vented when exposed to outlet openings 266 formed in plate 262. This is generally indicated by arrows 278 and 280. From here, the fluid flows through ports 248 formed in the ring member 246 and to the exterior of the sander 200. Unlike many prior art devices, venting the fluid through ports 248 formed in ring member 246 has a number of advantages. For example, many prior art devices closed off the end of the sander body and vented through a mid-portion thereof. This required difficult masking of the body. Other prior art devices also closed off the end of the bore with a complex member used to join the rotor assembly to the housing. The present invention uses a straight-forward ring 246 which not only securely joins elements 212 and 262 together, but permits fluid to readily flow therethrough.

With respect to said sander 200, speeds of 16,000 rpm at an air pressure of 90–100 psi. The chisel 20 delivers 2500 blows per minute at air pressure of 90–100 psi.

By the use of the device of the present invention, a substantial number of disadvantages associated with the prior art can be overcome. In addition to those advantages described above, the device of the present invention permits one body to be made which can then be dedicated either as a sander or as a chisel. It should be understood that while the preferred examples relate to the embodiments set forth in the drawings, it will be apparent to one of ordinary skill in the art that other changes and modifications can be made without departing from the spirit and scope of the present invention as defined in claims. This invention, therefore, is not to be limited to that which is specifically shown or discussed herein.

I claim:

1. A tool device comprising:

(a) a body defining a bore having a first barrier wall end and second open end;

(b) a tool holder and motor assembly joined to said body and extending into said bore, said assembly including (i) means for joining a tool to said assembly, said tool joining means extending out of said open end of said bore, (ii) elongated rotary motor means having first and second ends, said motor means joined to said tool joining means for rotating said tool joining means, said motor means further having a plurality of radially disposed movable vane members, and (iii) first and second end plates disposed on said motor means at each end thereof, said first end plate located adjacent said barrier wall end of said bore and having inlet openings for directing a fluid into said motor means and said second end plate located adjacent said open end of said bore and having outlet openings for directing fluid out of said motor means and toward said open end of said bore;

(c) means in said body for directing a fluid to said motor means adjacent said barrier wall and through said first end plate; and (d) means a ring member circumferentially disposed about said tool joining means and securing said assembly in said body, said ring member joined to said body adjacent said open end of said bore and having a plurality of openings in flow communication with and adjacent to said outlet openings on said second end plate, whereby fluid is directed from said barrier wall end of said bore, through said motor means, and out said open end of said bore.

* * * * *